US005720357A

United States Patent [19]

Fuller et al.

[11] Patent Number: 5,720,357

[45] Date of Patent: Feb. 24, 1998

[54] CUTTER ASSEMBLIES FOR ROTARY DRILL BITS

[75] Inventors: John M. Fuller, Nailsworth; Malcolm R. Taylor, Gloucester, both of England

[73] Assignee: Camco Drilling Group Limited, Stonehouse, England

[21] Appl. No.: 611,393

[22] Filed: Mar. 6, 1996

[30] Foreign Application Priority Data

Mar. 8, 1995 [GB] United Kingdom ..... 9504634

[51] Int. Cl.[6] ..... E21B 10/46

[52] U.S. Cl. ..... 175/428; 175/432; 76/108.2

[58] Field of Search ..... 175/405.1, 420.1, 175/420.2, 428, 432, 434, 435, 374; 76/108.2, 108.4

[56] References Cited

U.S. PATENT DOCUMENTS

| | | | |
|---|---|---|---|
| 4,047,583 | 9/1977 | Dyer | 175/374 X |
| 4,823,892 | 4/1989 | Fuller | 175/428 |
| 4,972,912 | 11/1990 | Keshavan | 175/432 |
| 4,991,670 | 2/1991 | Fuller et al. | 175/428 |
| 5,007,493 | 4/1991 | Coolidge et al. | 175/432 |
| 5,303,785 | 4/1994 | Duke | 175/420.2 X |
| 5,314,033 | 5/1994 | Tibbitts | 175/434 X |
| 5,348,109 | 9/1994 | Griffin | 175/428 X |
| 5,505,273 | 4/1996 | Azar et al. | 175/432 X |

FOREIGN PATENT DOCUMENTS

| | | |
|---|---|---|
| 2276896 | 10/1994 | United Kingdom . |
| 9415059 | 7/1994 | WIPO . |

*Primary Examiner*—William P. Neuder

[57] ABSTRACT

A cutter assembly for a rotary drag-type drill bit includes a preform cutting element comprising a front facing table of polycrystalline diamond bonded to a tungsten carbide substrate, the cutting element being mounted on a tungsten carbide carrier which is received in a socket in the body of the drill bit. The carrier comprises a sector-shaped portion of a disc, and the cutting element is bonded to one of the straight edge surfaces of the carrier, adjacent the apex of the sector shape. The side surfaces of the carrier taper inwardly, as viewed in cross-section, as they extend towards the curved edge surface of the carrier.

18 Claims, 2 Drawing Sheets

FIG 1
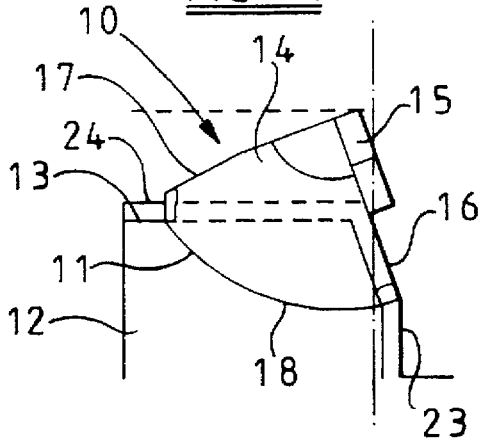
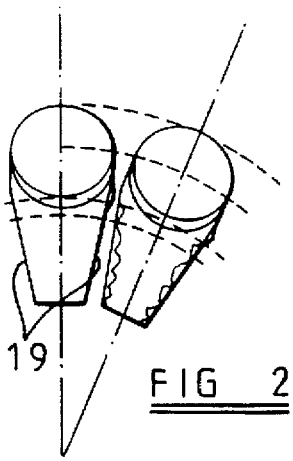
FIG 2
FIG 3A
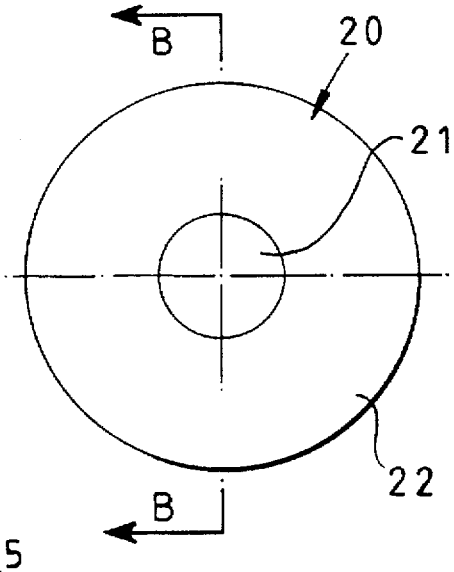
FIG 3B
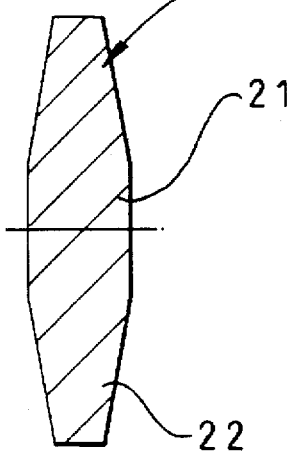
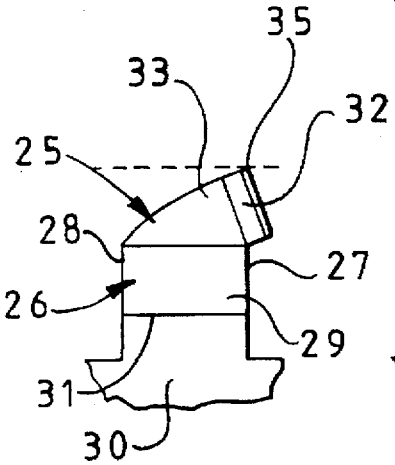
FIG 4
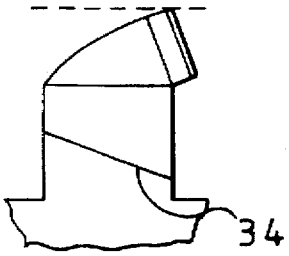
FIG 5
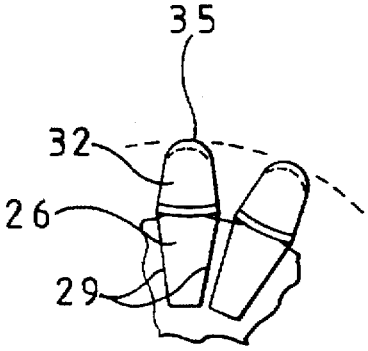
FIG 6

CUTTER ASSEMBLIES FOR ROTARY DRILL BITS

BACKGROUND OF THE INVENTION

1. Field of the Invention

The present invention relates to cutter assemblies for drill bits used in drilling or coring holes in subsurface formations, and more particularly, to cutter assemblies used in drag-type drill bits.

2. Description of Related Art

Drag-type drill bits generally comprise a bit body having a shank for connection to a drill string, a plurality of cutter assemblies mounted at the surface of the bit body, and a passage in the bit body for supplying drilling fluid to the surface of the bit body for cooling and/or cleaning the cutter assemblies. In drag-type drill bits of this kind the bit body may be machined from metal, usually steel, sockets to receive the cutter assemblies being machined in the bit body. Alternatively, the bit body may be molded from tungsten carbide matrix material using a powder metallurgy process.

The present invention relates to the structure of cutter assemblies, for use in such a drill bit, and of the kind comprising a preform polycrystalline diamond cutting element mounted on a carrier of material which is less hard than the diamond, the carrier then in turn being secured within a socket in the bit body. A common form of cutting element comprises a flat tablet, usually circular, having a front cutting table of polycrystalline diamond bonded to a substrate of less hard material, such as cemented tungsten carbide. The layer of polycrystalline diamond is formed and bonded to the substrate in a high pressure, high temperature press, and one or more transition layers may sometimes be provided between the cutting table and substrate. The general details of manufacture of such cutting elements are well known and do not form a part of the present invention.

Hitherto, the carrier has usually been in the form of a cylindrical post or stud and may, for example, also be formed from cemented tungsten carbide. Each cutting element is normally mounted on its carrier by brazing the rear surface of the substrate to a surface of the carrier. However such current forms of carrier have certain disadvantages. In the case of a cylinder cutter, where the cutting element is coaxial with a cylindrical stud and is brazed to one end thereof, only a relatively low exposure of the cutting element is possible above the surface of the bit body in which the carrier is received. It is currently believed that increase of the cutter exposure can improve the rate of penetration of a drag-type drill bit, but high cutter exposures are not generally possible with cylinder cutter assemblies. Furthermore, in order to achieve maximum exposure of the cutting element, a significant part of the carrier must project clear of its socket in the bit body, thus reducing the available braze area between the carrier and the bit body, with the risk that the assembly might become detached from the bit body.

In post cutters the cutting element is normally brazed to an inclined surface at one end of a cylindrical post, the opposite end of the post being received in a corresponding cylindrical blind socket in the bit body. Such an arrangement allows higher cutter exposure than cylinder cutters, but the high exposure causes high transverse loads on the carrier post leading to a risk of the post snapping.

There are also other disadvantages with post cutters, for example it may be difficult to braze the posts in their sockets and it may be difficult to achieve high cutter density since there must be maintained a minimum thickness of bit body material between adjacent cylindrical sockets. Since adjacent posts are often inclined to one another, the requirement for a minimum amount of material separating the sockets at their inner ends results in a necessarily wide separation of the cutters at the opposite, projecting ends of the posts.

SUMMARY OF THE INVENTION

The present invention sets out to provide improved forms of cutter assembly, and methods of mounting such assemblies on a drill bit. According to one aspect of the invention there is provided a cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, which carrier is, in use, received in a socket in the body of the drill bit, at least part of the carrier comprising a portion of a disc, and having opposite side faces defined by parts of opposite side surfaces of the disc, and a curved edge surface defined by part of the peripheral edge of the disc. Since the carrier comprises a portion of a disc, it may be generally sector-shaped, being of large extent in side view but narrow in cross-section. The shape therefore allows for strong cutter support, permitting high exposure of the cutting element on the carrier, while at the same time allowing close packing of adjacent cutter assemblies.

The large side area provided by the cutter provides a large area for brazing so that the cutter may be firmly secured within its socket. The carrier may further include front and rear surfaces extending transversely of the side surfaces and curved edge surface. The cutting element may be bonded to the front surface of the carrier. Said front and rear surfaces may meet at a location remote from the curved edge of the carrier, so that, as mentioned above, the carrier is substantially sector-shaped. At least one of said surfaces may extend substantially normally to the curved edge of the carrier. Said opposite side surfaces of the carrier preferably taper inwardly, as viewed in cross-section, as they extend towards the curved edge surface of the carrier. Such tapered arrangement further improves the packing density of adjacent cutter assemblies.

The invention also provides other forms of cutter assembly which achieve similar advantages but where the carrier is not in the form of part of a disc. Thus, according to a second aspect of the invention, there is provided a cutter assembly for a rotary drag-type drill bit of the kind previously referred to, wherein at least part of the carrier is in the form of a block having a front surface, a rear surface, opposite side surfaces and a bottom edge surface, at least one of said front and rear surfaces being substantially flat, and the opposite side surfaces tapering inwardly, as viewed in cross-section, as they extend towards the bottom edge surface of the carrier. Preferably said tapering opposite side surfaces of the carrier are also flat. The flat front or rear surface may extend substantially at right angles to said bottom edge surface, or may be inclined thereto at an angle which is greater or less than a right angle. The other of the front and rear surfaces may also be substantially flat, in which case the from and rear surfaces may be substantially parallel to one another.

The invention also provides a method of mounting a cutter assembly of any of the above kinds in the body of a drill bit, the method comprising providing on the surface of the bit body an upstanding blade extending outwardly away from the longitudinal axis of rotation of the bit, the blade having a leading edge surface extending away from the surface of the bit body, forming a slot in the blade by passing a machine tool, in one or a succession of passes, through said leading edge surface and transversely through at least a part of the blade, the tool being of a cross-sectional shape corresponding to the cross-sectional shape of at least part of the carrier of the cutter assembly, and then brazing or otherwise securing said part of the carrier of the cutter assembly in said slot.

In the case where the part of the carrier of the cutter assembly comprises a portion of a disc, said tool is moved along a part-circular path of the same radius as the disc. In other cases the tool may be traversed along a linear path. The blade on the bit body may have a trailing edge surface, opposite said leading edge surface, and in this case the slot may also pass through said trailing edge surface.

The invention also includes within its scope a method of forming a carrier for a cutter assembly according to the first aspect of the invention, the method comprising forming a circular disc from a material suitable for the carrier of a cutter assembly, cutting said disc into a plurality of sectors by spaced cuts extending inwardly from the periphery of the disc, and mounting a cutting element on a surface of each sector remote from the curved edge of the sector. Said cuts may extend radially of the disc, or at an angle to a radius. Each cut may be substantially straight or may comprise two or more stretches at an angle to one another.

The method may also include further steps of shaping each sector subsequently to its being cut from the disc. In some forms of drag-type drill bit of the kind to which the present invention relates, back-up elements are located on the bit body rearwardly of some or all of the cutter assemblies. Such elements may comprise bearing elements, abrasion elements, or secondary cutters. The elements provide a back-up for the cutter assemblies, in case a cutter assembly becomes damaged or excessively worn, and may also absorb excessive loads which would otherwise be applied to the cutter assemblies, causing damage, such as impact loads. Where the cutter assemblies are cylinder or post cutters, the back-up element is currently located in a separate socket spaced rearwardly of the cutter assembly. The back-up element may, for example, comprise a stud of tungsten carbide or infiltrated matrix material impregnated with elements of natural or synthetic diamond, or a secondary cutter similar to the primary cutter assembly.

Due to the necessity of providing a separate socket, the back-up element has to be spaced a significant distance rearwardly of its associated cutter assembly and where the cutter assemblies are mounted on blades on the bit body, this requires the blades to be wider than they would otherwise be if the back-up elements were not provided. Currently it is believed that it is advantageous to provide large open areas between blades, so as to provide large exposure in front of the cutter assemblies along each blade. However, if the width of each blade has to be increased to accommodate back-up elements, the open area between adjacent blades must be correspondingly reduced.

According to a further aspect of the present invention, therefore, there is provided a novel and improved form of cutter assembly to provide back-up elements without significant increase in the width of the blades on which they might be mounted. The invention is particularly applicable to cutter assemblies according to the invention as previously described, but is also applicable to other types of cutter assembly. According to this aspect of the invention there is provided a cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, and which in use is received in a socket in the body of the drill bit, the cutter assembly including a back-up element mounted in a socket in the carrier rearwardly of the cutting element with respect to the normal direction of forward rotation of the cutting element during drilling. The back-up element may be an abrasion element comprising natural or synthetic diamond elements embedded in a carrier of material, such as tungsten carbide or infiltrated matrix material, which is less hard than the diamond.

Alternatively, the back-up element may comprise a portion of the carrier of the cutter assembly which is located rearwardly of the cutting element with respect to the normal direction of forward rotation of the cutting element during drilling, which portion projects further away from the bit than the cutting element itself whereby, in use, the projecting portion engages the formation before the cutting element. In each case the provision of the back-up element, since it is provided on the carrier of the cutter assembly itself, does not increase the space required for the cutter assembly/back-up element combination.

BRIEF DESCRIPTION OF THE DRAWINGS

FIG. 1 is a diagrammatic side elevation of one form of cutter assembly according to the invention.

FIG. 2 is a front elevation of two adjacent cutter assemblies of the kind shown in FIG. 1.

FIG. 3A shows a plan view of a disc from which carriers of the cutter assembly of FIG. 1 may be cut, FIG. 3B is a section along the line B—B of FIG. 3A.

FIGS. 4 and 5 are similar views to FIG. 1 of alterative forms of cutter assembly.

FIG. 6 is a from elevation of two adjacent cutter assemblies of the kind shown in FIG. 5.

DETAILED DESCRIPTION OF THE PREFERRED EMBODIMENTS

Figure 7:
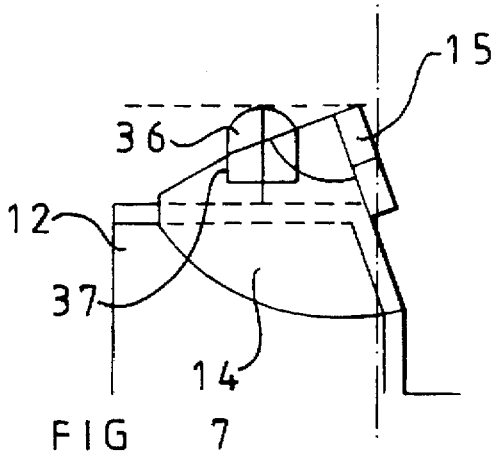
FIGS. 7 and 8 are similar views to FIGS. 1 and 2 of a modified form of cutter assembly.

FIG. 1 shows diagrammatically a cutter assembly 10 mounted in a socket 11 in a blade 12 which extends outwardly away from the longitudinal axis of rotation of a drag-type drill bit. The construction of such drill bits generally is well known and will not therefore be described in further detail. The bit body may be machined from steel or molded from solid infiltrated matrix material using well known powder metallurgy processes. The blade 12 may be formed with a hard facing layer 13. As is well known, a plurality of cutter assemblies are normally mounted side-by-side along each blade. In the arrangement of FIG. 1, the cutter assembly 10 comprises a carrier 14 of tungsten carbide or other suitable material on which is mounted a cutting element 15. The cutting element 15 is in the form of a circular tablet and comprises a front facing table of polycrystalline diamond bonded to a substrate of tungsten carbide. The rear surface of the tungsten carbide substrate is brazed to a surface on the carrier 14. The carrier 14 is generally in the form of a sector of a disc and comprises a front surface 16, a rear surface 17, and a lower curved edge surface 18. The front surface 16, to which the cutting element 15 is brazed at a location remote from the curved edge surface 18, extends substantially normally to the curved surface 18. The rear surface 17 comprises three portions each portion being inclined at an angle to the adjacent one.

The opposite side surfaces 19 of the carrier 14 taper inwardly as they extend towards the curved edge surface 18 of the carrier. As may be seen from FIG. 2, this permits close packing of adjacent cutter assemblies on a curved portion of the blade 12. The side surfaces 19 may be flat, or may be ridged or serrated.

As previously mentioned, the sector shape of the carrier 14 provides large areas on each side of the carrier for brazing it into the socket 11 and thus provides secure mounting and strength for the carrier while, at the same time, the narrow tapering cross-sectional width of the carrier allows for close packing of adjacent assemblies. The strong support provided by the carrier also allows high exposure of the cutting element 15 above the surface of the blade 12, as may be seen from FIG. 1.

FIGS. 3A and 3B show in plan view and section the shape of a disc 20 from which may be formed a number of the carders 14. The disc comprises a central circular portion 21 the opposite faces of which are parallel, and an outer annular portion 22 where the opposite faces taper towards one another. Four carders 14 can be cut from the disc 20, but it will be appreciated that a greater or lesser number of carders of different shape may also be cut from a single disc if required. The disc 20 is first cut into the appropriate number of sectors and each sector is then further shaped to provide the required configuration of the carrier, particularly those parts thereof which project beyond the blade 12. The surface 16 to which the cutting element 15 is brazed may be ground.

The socket 11 in the bide 12 is in the form of a slot extending from the front face 23 of the blade and the outer face 24. Since the carrier is formed from a disc, the slot 11 may be readily formed by passing through the blade 12, in one or more passes, a machining tool the cross-sectional shape of which corresponds to the cross-sectional shape of the disc 20. Thus, the tool may itself comprise a cutting disc of the same shape as the disc 20 which is rotated so as to cut the slot 11 in the blade 12.

FIGS. 4–6 show alterative arrangements according to the invention where the carrier is not formed from part of a disc. Referring to FIG. 4, the carrier 25 of the cutter assembly includes a lower part 26 in the form of a block having a front face 27, a rear face 28 and tapering side faces 29. The blade 30 on the drill bit is then formed with a straight taper-sided slot 31 cut through the whole width of the blade 30 and corresponding in cross-section to the shape of the block part 26 of the carrier 25. The cutting element 32 is brazed to an inclined surface on a portion 33 of the carrier which is integral with the block 26 but which projects beyond the surface of the blade 30 when the block 26 is received within the slot 31.

FIG. 5 shows an alternative arrangement where the lower surface 34 of the block part of the carrier is inclined, so as to provide greater resistance to rearward loads on the cutter assembly. FIG. 6 is a front view of two adjacent cutter assemblies of the kind shown in FIGS. 4 and 5 and it will be seen that the tapering sides 29 of the block part 26 allow close packing of adjacent assemblies as in the previously described arrangement. It will be seen that each cutting element 32 is in the form of a tablet but in this case it is not of circular form. A number of the shaped cutting elements 32 may comprise sectors cut from a flat annular ring comprising an annular table of polycrystalline diamond bonded to a corresponding annular substrate of tungsten carbide. The cutting elements 32 are formed by making spaced radial cuts in the annulus and then rounding the part of each sector which formed the inner periphery so as to provide the cutting edge 35 of the cutting element.

Figure 8:
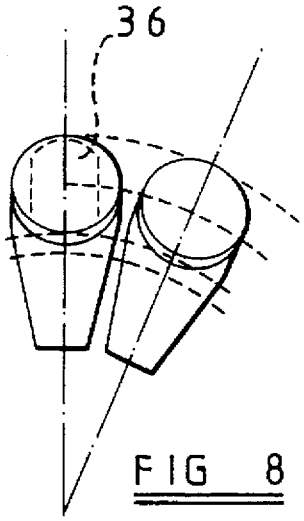

FIGS. 7 and 8 show a modified version of the cutter assembly shown in FIGS. 1 and 2, and corresponding parts have corresponding reference numerals. In the arrangement of FIGS. 7 and 8, however, a back-up bearing element 36 is located rearwardly of the cutting element 15 and is received in a socket 37 in the part of the carrier 14 which projects above the outer surface of the blade 12. The back-up element 36 may be of any suitable form. For example it may comprise a cylindrical domed stud of tungsten carbide or infiltrated matrix material impregnated with natural or synthetic diamond elements. Alternatively, it might be a simple tungsten carbide stud which acts solely as a bearing element without having any abrading action. Alternatively, the stud might have embedded in it one or more blocks of polycrystalline diamond material. The socket 37 for the back-up element requires to be cut in the carrier and the carrier is therefore preferably formed from a material which can be readily machined. For example, it may be of the kind where the tungsten carbide is combined with a proportion of tungsten metal, which has the effect of improving machinability.

Figure 9:
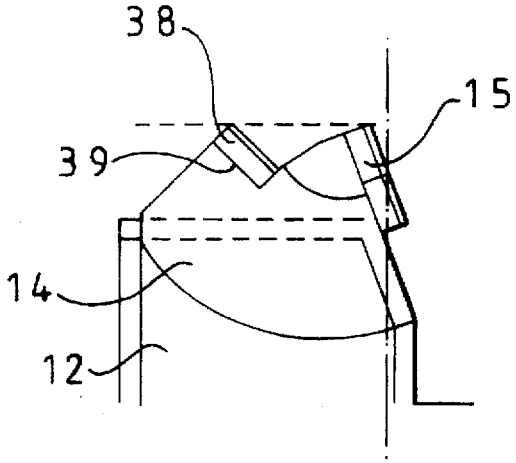
FIGS. 9 and 10 are side elevations of further modified versions.
Figure 10:
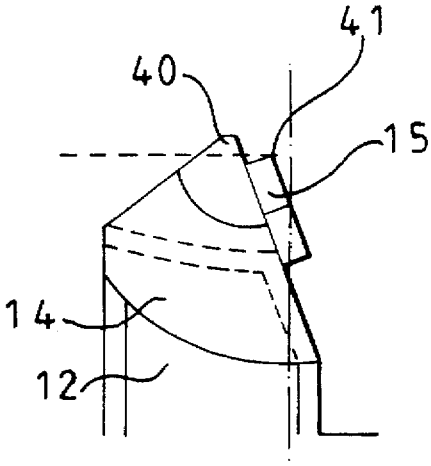

In the alterative arrangement shown in FIG. 9, there is provided behind the primary cutter 15 a secondary cutting element 38 bonded to an inclined surface 39 formed on the carrier 14. The secondary cutting element 38 may be of generally similar form to the primary cutting element 15 but may be mounted at a different back rake angle, as shown in FIG. 9. In the arrangements of FIGS. 7–9, the mounting of the bearing element or secondary cutting element on the carrier of the primary cutting element reduces the overall space required to accommodate the two elements, thus allowing reduction in the width of the blade 12, giving the advantages previously referred to. Instead of the back-up element comprising a separate element mounted on the carrier of the primary cutting element, a part of the carrier itself may be shaped so as to act as a bearing element, and such an arrangement is shown in FIG. 10. In this arrangement the part of the carrier 14 rearwardly of the cutting element 15 is shaped to provide a projection 40 which projects outwardly beyond the cutting edge 41 of the cutting element 15. In use, therefore, the projection 40 engages the formation before the cutting edge 41 does, and this may reduce the risk of impact damage to the cutting element 15 when the drill bit is first introduced downhole and may enhance dynamic stability of the drill bit when new. It will be appreciated that the projection 40 will only be effective when the bit is new, since it becomes worn away comparatively rapidly as drilling proceeds.

Although the mounting of a back-up element on the carrier itself is particularly applicable to carriers of the kind shown in FIGS. 1–6, it will be appreciated that the concept is not limited to cutter assemblies of this type and may be applied to any other form of cutter assembly where there is sufficient width of carrier behind the primary cutting element to accommodate the back-up element.

Whereas the present invention has been described in particular relation to the drawings attached hereto, it should be understood that other and further modifications, apart from those shown or suggested herein, may be made within the scope and spirit of the present invention.

What is claimed:

1. A cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, which carrier is, in use, received in a socket in the body of the drill bit, at least part of the carrier which, in use, is received in the socket in the body of the drill bit comprising a portion of a disc, and having opposite side faces defined by parts of opposite side surfaces of the disc, and a curved edge surface defined by part of the peripheral edge of the disc.

2. A cutter assembly according to claim 1, wherein the carrier further includes front and rear surfaces extending transversely of the side surfaces and curved edge surface.

3. A cutter assembly according to claim 2, wherein the cutting element is bonded to the front surface of the carrier.

4. A cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, which carrier is, in use, received in a socket in the body of the drill bit, wherein at least part of the carrier is in the form of a block having a front surface, a rear surface, opposite side surfaces and a bottom edge surface, at least one of said front and rear surfaces being substantially flat so as to meet each of the side surfaces at an angle, and the opposite side surfaces tapering inwardly, as viewed in cross-section, as they extend towards the bottom edge surface of the carrier.

5. A cutter assembly according to claim 4, wherein said tapering opposite side surfaces of the carrier are also flat.

6. A cutter assembly according to claim 4, wherein said at least one of the from and rear surfaces extends substantially at right angles to said bottom edge surface.

7. A cutter assembly according to claim 4, wherein, both said front and rear surfaces are substantially flat, and are substantially parallel to one another.

8. A cutter assembly for a rotary drag-type drill bit, including a preform cutting element comprising a front facing table of polycrystalline diamond bonded to a substrate of a material which is less hard than the diamond, the cuffing element being mounted on a carrier, also of a material which is less hard than the diamond, which carrier is, in use, received in a socket in the body of the drill bit, at least part of the carrier comprising a portion of a disc, and having opposite side faces defined by parts of opposite side surfaces of the disc, and a curved edge surface defined by part of the peripheral edge of the disc, the carrier further including front and rear surfaces which extend transversely of the side surfaces and curved edge surface and meet at a location remote from the curved edge of the carrier, so that the carrier is substantially sector-shaped.

9. A cutter assembly according to claim 8, wherein at least one of said surfaces extends substantially normally to the curved edge of the carrier.

10. A cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, which carrier is, in use, received in a socket in the body of the drill bit, at least part of the carrier comprising a portion of a disc, and having opposite side faces defined by parts of opposite side surfaces of the disc, and a curved edge surface defined by part of the peripheral edge of the disc said opposite side surfaces of the carrier tapering inwardly, as viewed in cross-section, as they extend towards the curved edge surface of the carrier.

11. A method of mounting in the body of a drill bit a cutter assembly including a preform cutting element comprising a front facing table of polycrystalline diamond bonded to a substrate of a material which is less hard than the diamond, the cutting element being mounted on a carrier, also of a material which is less hard than the diamond, at least part of the carrier comprising a portion of a disc, and having opposite side faces defined by parts of opposite side surfaces of the disc, and a curved edge surface defined by part of the peripheral edge of the disc, the method comprising providing on the surface of the bit body an upstanding blade extending outwardly away from the longitudinal axis of rotation of the bit, the blade having a leading edge surface extending away from the surface of the bit body, forming a slot in the blade by passing a machine tool, in at least one pass, through said leading edge surface and transversely through at least a part of the blade, the tool being of a cross-sectional shape corresponding to the cross-sectional shape of at least part of the carrier of the cutter assembly, and then securing said part of the carrier of the cutter assembly in said slot.

12. A method according to claim 11, and where the part of the carrier of the cutter assembly comprises a portion of a disc, wherein said tool is moved along a part-circular path of the same radius as the disc.

13. A method according to claim 11, wherein the blade on the bit body has a trailing edge surface, opposite said leading edge surface, and the slot passes through said trailing edge surface.

14. A method of forming a carrier for a cutter assembly, for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, which carrier is, in use, received in a socket in the body of the drill bit, at least part of the carrier comprising a portion of a disc, and having opposite side faces defined by parts of opposite side surfaces of the disc, and a curved edge surface defined by part of the peripheral edge of the disc, the method comprising forming a circular disc from a material suitable for the carrier of a cutter assembly, cutting said disc into a plurality of sectors by spaced cuts extending inwardly from the periphery of the disc, and mounting a cutting element on a surface of each sector remote from the curved edge of the sector.

15. A method according to claim 14, wherein said cuts extend generally radially of the disc.

16. A method according to claim 14, wherein each cut is substantially straight.

17. A method according to claim 14, including the further step of shaping each sector subsequently to its being cut from the disc.

18. A cutter assembly for a rotary drag-type drill bit, including a preform cutting element comprising a front facing table of polycrystalline diamond bonded to a substrate of a material which is less hard than the diamond, the cutting element being mounted on a carrier, also of a material which is less hard than the diamond, and which in use is received in a socket in the body of the drill bit, the cutter assembly including a back-up element on the carrier rearwardly of the cutting element with respect to the normal direction of forward rotation of the cutting element during drilling, the back-up element comprising a portion of the carrier of the cutter assembly which is located rearwardly of the cutting element with respect to the normal direction of forward rotation of the cutting element during drilling, which portion projects further away from the bit than the cutting element itself whereby, in use, the projecting portion engages the formation before the cutting element.

* * * * *